United States Patent [19]

Helms

[11] 3,950,114

[45] Apr. 13, 1976

[54] TURBINE BLADE

[75] Inventor: Harold E. Helms, Indianapolis, Ind.

[73] Assignee: General Motors Corporation, Detroit, Mich.

[22] Filed: Feb. 23, 1968

[21] Appl. No.: 707,556

[52] U.S. Cl. ..... 416/97 A; 416/229 A; 416/231 R

[51] Int. Cl.[2] ..... F01D 5/18

[58] Field of Search ..... 253/39.15 B, 39.1 B, 39.15, 253/77 S, 77 SB, 77 SP, 77 PP; 416/97

[56] References Cited

UNITED STATES PATENTS

| | | | |
|---|---|---|---|
| 2,807,435 | 9/1957 | Howlett et al. | 253/77 |
| 2,817,490 | 12/1957 | Broffitt | 253/39.15 |
| 2,853,272 | 9/1958 | Odds | 253/77 |
| 3,011,761 | 12/1961 | Conway et al. | 253/39.15 |

*Primary Examiner*—Samuel Feinberg
*Attorney, Agent, or Firm*—Paul Fitzpatrick

[57] ABSTRACT

A turbine blade having a porous hollow sheet metal airfoil and a base defining a platform, stalk, and root. The airfoil portion is integral with an extension which lies within the blade stalk, the base being cast around this extension. The cast metal lies around the blade wall and also through tubes welded from wall to wall of the extension. The stalk also includes an opening to admit air to the interior of the blade for transpiration through the blade wall.

12 Claims, 10 Drawing Figures

INVENTOR.
Harold E. Helms
BY
Paul Fitzpatrick
ATTORNEY

INVENTOR.
Harold E. Helms
BY
Paul Fitzpatrick
ATTORNEY

TURBINE BLADE

The invention herein described was made in the course of work under a contract or subcontract thereunder with the Department of Defense.

DESCRIPTION

My invention relates primarily to the provision of improved cooled blades for high temperature turbomachinery although it may have other uses. The invention is directed primarily to providing an improved mode of attaching a base to the airfoil portion of the blade. The blade airfoil portion may be a porous laminated metal structure of the type described in copending patent applications, of common ownership with this application, Ser. No. 526,207 of Bratkovich and Meginnis for Laminated Porous Metal, filed Feb. 9, 1966, U.S. Pat. No. 3,584,972 and Ser. No. 691,834 of Emmerson for Turbine Cooling, filed Dec. 19, 1967. My invention is directed primarily to the attainment of a feasible mode of attaching a root or base to a hollow sheet metal airfoil so that the joint between the airfoil and base is at least as strong as the airfoil and is adapted to withstand the extremely high temperatures encountered in certain modern gas turbine engines.

I am aware that there have been prior proposals to cast blades to wheels or bases or otherwise to fix solid bases onto hollow sheet metal blades; see, for example, U.S. Pat. Nos. 1,005,736 of Wilkinson, 2,817,490 of Broffitt, and 3,073,568 of Stalker. However, a blade according to my invention involves novel structural features and is more suited to the requirements of practice.

The principal objects of my invention are to provide an improved structure for mounting a hollow blade on a turbine rotor or the like, to provide an improved means for fitting a base to a blade of porous laminated sheet metal, and to reduce the present high cost of high temperature turbine blades.

The value and significance of my invention will be apparent to those skilled in the art from the succeeding detailed description of the preferred embodiment of the invention, and the accompanying drawings thereof.

Figure 2:
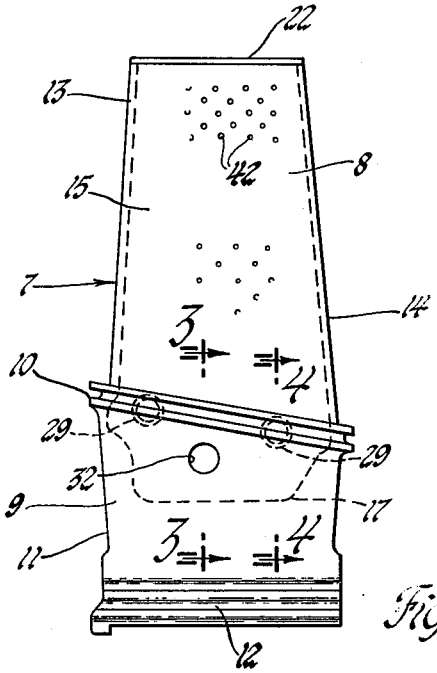
FIG. 2 is a side elevation of the same.
Figure 3:
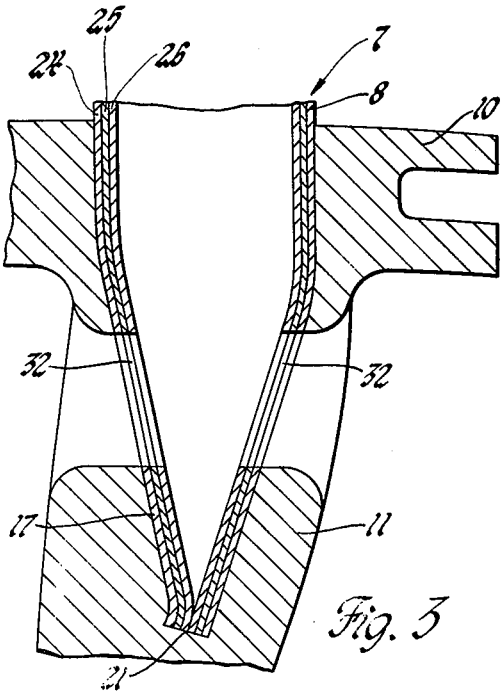
Figure 4:
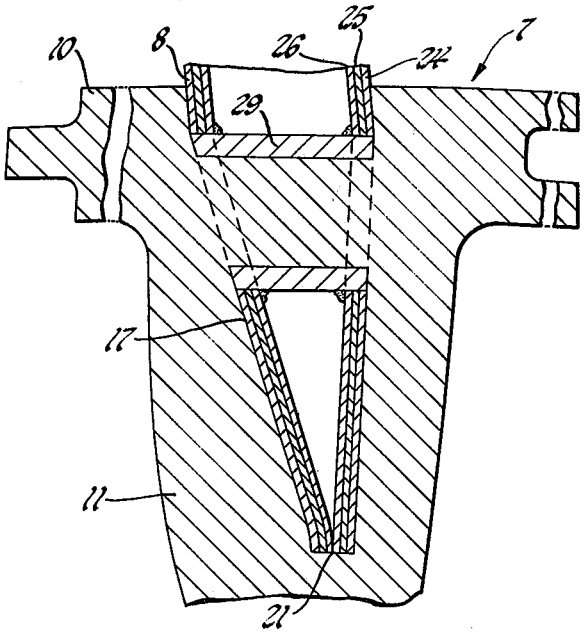

FIGS. 3 and 4 are fragmentary sectional views to an enlarged scale taken on the planes indicated by the lines 3—3 and 4—4 in FIG. 2.

Figure 5:
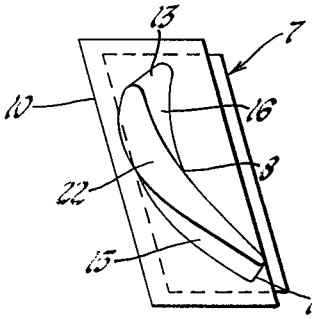

FIG. 5 is a plan view of the assembly.

Figure 6:
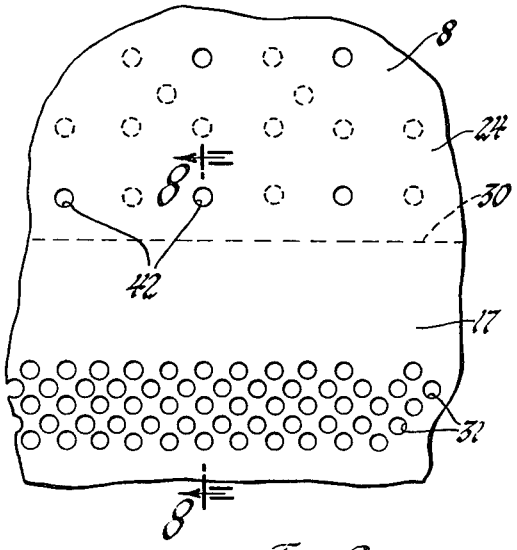

FIG. 6 is a fragmentary enlarged elevation view of a side of the blade portion.

Figure 7:
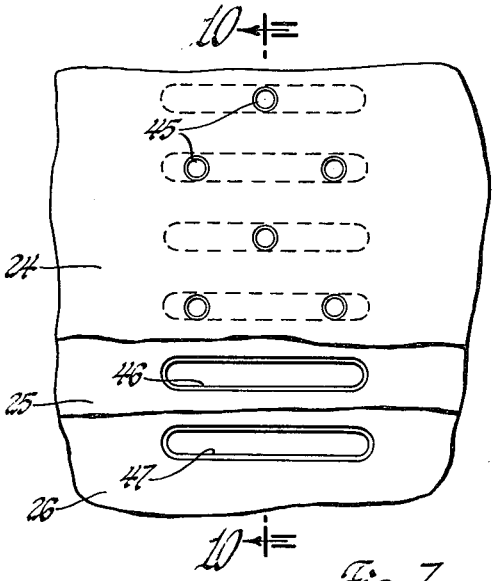

FIG. 7 is a fragmentary enlarged developed view at the leading edge of the blade, with parts cut away.

Figure 8:
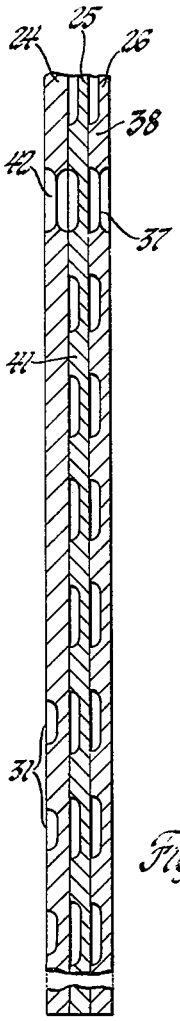

FIG. 8 is an enlarged spanwise section at the inner end of the span of the blade taken in the plane indicated by the line 8—8 in FIG. 6.

Figure 9:
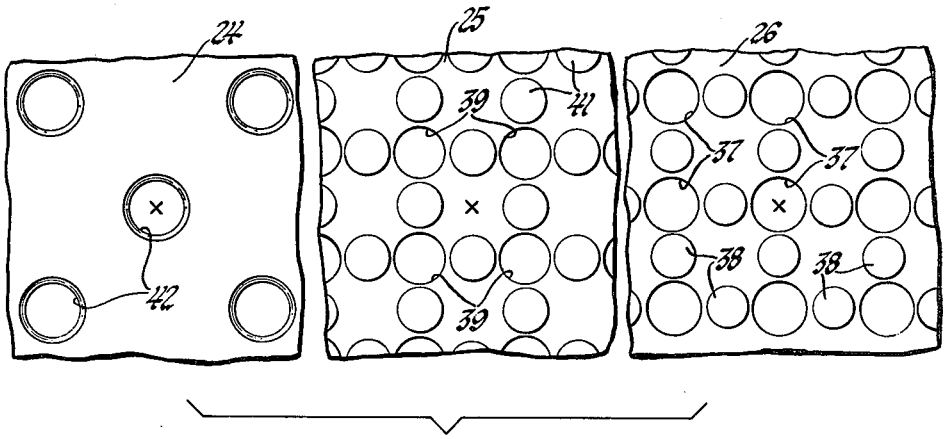

FIG. 9 is an exploded view of the laminated sheet metal of the blade wall illustrating typical structure of the laminae providing for controlled flow of cooling fluid through the blade wall.

Figure 10:
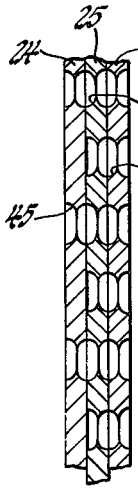

FIG. 10 is a spanwise section through the leading edge of the blade taken on the plane indicated by the line 10—10 in FIG. 7.

Figure 1:
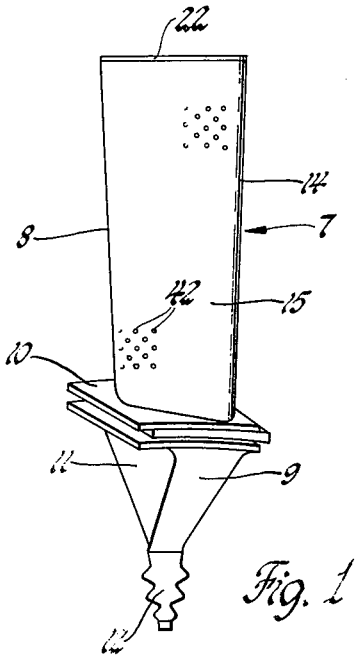
FIG. 1 is an elevation view of a turbine blade assembly as viewed from downstream toward the trailing edge.

Referring first to FIGS. 1, 2, and 5, it will be apparent to those skilled in the art that the blade assembly 7 is of conventional overall form. It includes a blade 8 extending from a base member 9. The blade 8, as appears from FIG. 5, is of twisted airfoil configuration, and may be of any shape suited to the particular installation. The base, as illustrated, is an integral casting which consists of three main portions; a platform 10, a stalk 11, and a root 12, the root being of multiple dovetail configuration adapted to be retained in suitable slots in a turbine rotor. The blade has a radiused leading edge 13 and a trailing edge 14, a convex wall 15, and a concave wall 16. The walls are spaced apart to provide a hollow blade and both extend from the leading edge to the trailing edge. The blade platform 10 is of parallelogram shape and has tongue-and-groove margins for overlapping engagement with adjacent blade platforms and for engagement with seal rings or equivalent structure provided to block flow of motive fluid between the blade stalks and to direct cooling air to the blades.

Referring now also to FIGS. 3 and 4, it may be noted that the blade 8 includes the airfoil portion already described and an attaching portion 17 which is a continuation of the blade walls extending into the base; specifically, through the platform and into the stalk. The preferred spanwise extent of the attaching portion will be apparent from FIG. 2 where its margin is indicated in a broken line. As shown in FIGS. 3 and 4, the walls of the blade converge towards each other within the base and are welded together at the inner end at 21. The base end of the blade may be left open, but in this case must be plugged when the wax pattern of the base is cast onto the blade. FIGS. 3 and 4 also indicate that the blade walls are of a three-layer laminated structure. The three layers may be identified as outer layer 24, middle layer 25, and inner layer 26. In the specific example described here, the blade has about two and one-half inches free span and the layers of the wall are each about nine thousandths of an inch thick. The blade also includes an end cap 22 closing the outer end of the airfoil.

The base 9 is cast around the attaching portion of the blade and is interlocked to it primarily by two tubes 29 (FIGS. 2 and 4) which extend across the attaching portion of the blade from wall to wall slightly below the top of the platform. These tubes are welded to the blade walls and are filled with the base metal when it is cast around the blade. This provides a secure and positive interlock between the blade and base.

It is considered desirable also in some cases to provide a rough surface on the exterior of the attaching portion 17 for further interlock between the base and the blade, and this may be done during the manufacture of the outer layer of the blade.

In FIG. 6, a portion of a side wall of the blade is shown, the outer surface of the blade platform being indicated by the broken line 30. The airfoil portion of the blade 8 is depicted above the line and the attaching portion 17 below the line. Referring also to FIG. 8, it will be seen that an array of small pits is formed in the outer surface of the attaching portion, these pits preferably being created by some such process as photoetching. Thus, when the base is cast around the blade, the material of the base will enter the pits 31 to interlock with the blade.

Air is supplied to the blade through two holes 32 in the sides of the blade attaching portion and the blade base. These holes are machined after the base is cast around the blade so that air can flow from the space between the wheel and platform into the interior of the blade. Holes 32 preferably are chamfered as shown.

So far as the means for providing the blade root are concerned, the structure of the blade exterior to the root is not particularly material, since the blade root attachment can be used with blades of various sorts. In fact, it appears feasible to cast the blades directly into a turbine wheel if desired. Thus, platform 10 and stalk 11 could be integral parts of a turbine wheel. For lower temperature service, the blade could be cast into a wheel directly as Wilkinson's disclosure. However, since the attachment mode is particularly suited to porous laminated blades, it seems desirable to describe the structure of a preferred airfoil briefly.

FIG. 9 illustrates, greatly enlarged, typical structure of the outer layer 24, middle layer 25, and inner layer 26 before they are bonded together to form the laminated sheet which is then formed into the blade. The three views in FIG. 9 all display an X which indicates a point of registry of the three layers. The inner layer has holes 37 and is provided with bosses 38 which space the layers so cooling air can flow to holes 39 in the middle layer 25 which also has bosses, identified as 41, on its outer surface. The outer layer 24 has cooling air holes or pores 42 distributed over its surface. The holes in the inner and outer layers are in registry and the holes in the intermediate layer are out of registry with these. The size and spacing of the holes in the several layers and the height of the bosses are such as to provide the desired permeability, which may vary over the surface of the blade according to the local need for cooling. The blade cap 22 preferably has a laminated porous tructure similar to that of the blade wall just described.

At the leading edge of the blade, as shown in FIGS. 7 and 10, the structure is somewhat different. Here the outer layer 24 has a number of very small holes or pores 45 which overlie small aligned slots 46 and 47 in the middle and inner layers 25 and 26, respectively. This structure provides a considerable flow of cooling air out the leading edge of the blade for film cooling and also facilitates the forming of the rather sharp radius at the leading edge.

The application of the improved blade to a turbine should be clear, but it may be pointed out briefly that the blade is mounted in a wheel of such structure as to supply cooling air to the space between the platforms and wheel, which cooling air can enter the interior of the blade through the hole 32 in the root and flow through the walls of the blade to cool the blade and shield it against the very hot motive gases. The structure interconnecting the blade and base provides an extremely strong and rugged bond and is easily accomplished, since the base is simply cast around the blade. Blades as described herein have been tested to 2800°F. with no attachment failures. Experience so far indicates that failures occur within the airfoil rather than the attachments.

While it seems clear that my invention could be applied to metals which do not have high temperature capabilities so as to raise their temperature capabilities to the range of temperatures encountered in present day uncooled gas turbines, the effort put into my invention so far has been directed toward raising the temperature levels at which high temperature alloys may be used in gas turbines. Principal experience so far has been with blades with a blade portion of Rene 41 and a base of Waspaloy. These materials are commercially available under A.M.S. Specifications No. 5544 for Waspaloy and No. 5545 for Rene 41. The compositions are tabulated below:

| | Cr | Co | Mo | Al | Fe | Ni |
|---|---|---|---|---|---|---|
| Waspaloy | 19.5 | 13.5 | 4.3 | 1.4 | — | Base |
| Rene 41 | 19 | 11 | 10 | 1.5 | 5.0 | Base |

A considerable degree of care and skill is required to manufacture sound blades from these materials, but it can be done with suitable equipment. The steps involved in the preferred process for manufacture of such a blade may be outlined as follows: After the porous metal has been laminated and formed into the blade wall and attaching portion, it is drilled for the tubes 29 and they are welded in place. Then, the lower end at 21 is plugged, if not already closed by the metal structure of the blade. The blade is dipped in wax to plug the pores temporarily and the attaching portion around which the base is to be cast is filled with a ceramic slurry. A wax pattern of the base is then cast around the blade and is invested in a suitable investment material with appropriate gates for casting.

This assembly is then heated in a stream autoclave to remove the wax from the blade and from the interior of the investment casting mold. Afterward, the assembly is heated to high temperature in an evacuated chamber to outgas the metal and cure the ceramic. With the blade metal specified, the temperature is raised to about 2100°F. The mold is then cooled in vacuum to about 1500° to 1600° and the base metal is poured into the mold in vacuum at 2500° to 2600°. The ceramic inside the blade is important as a heat sink to chill the laminated metal and freeze a layer of the cast metal against its outer surface, since its melting point is close to the pouring temperature of the base, and any melting of the blade material is undesirable. After the casting has cooled, the ceramic material inside is leached out or otherwise removed. The hole 32 through the blade attaching portion and base is machined, and the cap 22 is welded to the blade.

It is important to note that my blade involves a mechanical attachment rather than a metallurgical bond between the blade and base. For this reason, the interlock provided by the poured metal filling the tubes 29 is of great importance in assuring secure retention of the airfoil.

The detailed description of the preferred embodiment of my invention for the purpose of explaining the principles thereof is not to be considered as limiting the invention, since many modifications may be made by the exercise of skill in the art.

I claim:

1. A fluid-directing member for a turbomachine comprising, in combination, a hollow tubular porous metal blade including an airfoil portion with spaced fluid-directing walls and a hollow tubular attaching portion integral with the airfoil portion and extending therefrom, a base member to which the blade is attached, the attaching portion extending into the base member, at least one tube fixed to the attaching portion of the blade and extending from wall to wall thereof, the base member including a portion filling the tube integral with the remainder of the base member external to the attaching portion, and means defining an entrance into the airfoil portion for a cooling fluid through the base and attaching portion.

2. A fluid-directing member as recited in claim 1 in which there are at least two said tubes in each attaching portion.

3. A fluid-directing member as recited in claim 1 in which the walls of the attaching portion converge together to close the end of the attaching portion.

4. A fluid-directing member as recited in claim 1 in which the blade and base member are both made of high temperature alloys.

5. A fluid-directing member as recited in claim 1 in which the means defining an entrance is a hole through the wall of the attaching portion and the base member.

6. A fluid-directing member as recited in claim 1 in which the attaching portion is formed with an array of depressions within and interlocking with the base member.

7. A fluid-directing member as recited in claim 1 including also a cap bonded onto and closing the end of the blade remote from the base member.

8. A fluid-directing member for a turbomachine comprising, in combination, a hollow tubular porous metal blade including an airfoil portion with spaced fluid-directing walls and a hollow tubular attaching portion integral with the airfoil portion and extending therefrom as a continuation of the said walls, a base member including a blade platform, a blade stalk, and a blade root in a one-piece element, the attaching portion extending into the base member with the walls converging to a closure within the base member, at least one tube fixed to the attaching portion of the blade and extending from wall to wall thereof transverse to the blade stalk, the base member including a portion filling the said tube integral with the base member portions external to the attaching portion, and means defining an entrance into the airfoil portion for a cooling fluid through the blade stalk and the attaching portion.

9. A fluid-directing member as recited in claim 8 in which there are at least two said tubes in each attaching portion.

10. A fluid-directing member as recited in claim 8 in which the blade and base member are both made of high temperature alloys.

11. A fluid-directing member as recited in claim 8 in which the attaching portion is formed with an array of depressions within and interlocking with the base member.

12. A fluid-directing member as recited in claim 8 including also a cap bonded onto and closing the end of the blade remote from the base member.

* * * * *